US006397442B1

(12) United States Patent
Tanaka et al.

(10) Patent No.: US 6,397,442 B1
(45) Date of Patent: Jun. 4, 2002

(54) SAMPLE WARPER WITH SHORT FEED BELTS

(75) Inventors: Yoshihiro Tanaka; Takatsugu Aihara, both of Kiryu (JP)

(73) Assignee: Suzuki Warper Ltd., Gunma-ken (JP)

( * ) Notice: Subject to any disclaimer, the term of this patent is extended or adjusted under 35 U.S.C. 154(b) by 0 days.

(21) Appl. No.: 09/938,480

(22) Filed: Aug. 27, 2001

(30) Foreign Application Priority Data

Sep. 11, 2000 (JP) ..... 2000-275145

(51) Int. Cl.[7] ..... D02H 3/00
(52) U.S. Cl. ..... 28/190
(58) Field of Search ..... 28/190, 191, 192, 28/193, 194, 195, 196, 198, 184, 208; 242/472.8

(56) References Cited

U.S. PATENT DOCUMENTS 4,972,562 A * 11/1990 Tanaka et al. ..... 28/190
5,590,448 A * 1/1997 Lenzen et al. ..... 28/191
5,603,146 A * 2/1997 Heuermann et al. ..... 28/191
5,630,262 A * 5/1997 Tanaka ..... 28/184
5,950,289 A * 9/1999 Tanaka ..... 28/190
5,970,591 A * 10/1999 Tanaka et al. ..... 28/190
6,173,480 B1 * 1/2001 Tanaka ..... 28/190
6,192,560 B1 * 2/2001 Ulbrich et al. ..... 28/190

* cited by examiner

*Primary Examiner*—Amy B. Vanatta
(74) *Attorney, Agent, or Firm*—Arent Fox Kintner Plotkin & Kahn, PLLC

(57) ABSTRACT

In a sample warper, which includes a single yarn introduction means or a plurality of yarn introduction means for winding one or more yarns concurrently on a plurality of conveyer belts rotatably mounted on one side surface of a warper drum and movable on the warper drum at a predetermined rate of feed, a plurality of parallel lease rods arranged on a longitudinal side surface of the warper drum, and a creel on which a plurality of bobbins are supported, a plurality of short feed belts are mounted on the circumferential surface of the warper drum at its end adjacent to the yarn introduction means in such a way that the upper surface of the short feed belts are disposed radially outwardly of an imaginary cylindrical surface enclosing upper surfaces of the plural conveyer belts with respect to the axis of the warper drum. The yarn introduction means is operable to wind the yarns on the short feed belts so that the yarns are transferred from the short feed belts onto the plural conveyer belts for warping thereon.

45 Claims, 12 Drawing Sheets

SAMPLE WARPER WITH SHORT FEED BELTS

BACKGROUND OF THE INVENTION

1. Field of the Invention

The present invention relates to a sample warper equipped with short feed belts and capable of winding a yarn with effectively reducing increase of the tension of yarns, which would unavoidably occur during conventional warping, particularly during orderly winding yarns on a warper drum in successive warp turns. The present invention relates also to a method for winding yarns on the warper drum in successive warp turns using the above-mentioned sample warper.

2. Description of the Related Art

Conventional electronically-controlled sample warpers of the described type are exemplified by Japanese Patents Nos. 1,529,104 and 1,767,706 (U.S. Pat. No. 4,972,662 and European Patent No. 035480). The first-named Japanese publication discloses a sample warper W as shown in FIG. 9 of the accompanying drawings. The sample warper W of FIG. 9 comprises: a yarn introduction means 6, rotatably mounted on one side surface of a warper drum A for winding a yarn on the warper drum A; a plurality of yarn selection guides 27, associated with the yarn introduction means 6 and mounted on an end of a base Y supporting the warper drum A for association with the yarn introduction means 6 and, for moving angularly movable to project to a yarn exchanging position and retract to a standby position during yarn changing; a fixed creel B for supporting a plurality of bobbins 160, which are associated with the plural yarn selection guides 27 and on which various kinds or a single kind of yarns 22 are to be wound, thereby confirming transferring of the yarns 22 between the yarn introduction means 6 and the yarn selection guides 27 so that the yarns are automatically changed and successively wound neatly on the warper drum A in a preset sequence.

In the sample warper W, the plural yarn selection guides 27 receive the plural yarns 22, respectively, so that the individual yarns 22 of the fixed creel B can be successively wound on the warper drum W in a fully controlled manner. Reference numeral 17 designates a plurality of conveyer belts movably mounted on a circumferential surface of the warper drum A.

The second-named Japanese publication discloses another sample warper W for winding a plurality of yarns concurrently as shown in FIG. 10. The sample warper W of FIG. 10 has a plurality of yarn introduction means 6*a*–6*h* (eight yarn introduction means are shown in FIG. 10) for winding a plurality of yarns 22, which are paid out from a rotary creel F with a plurality of bobbins 160, on the conveyer belts 17.

Each of the sample warpers W shown in FIGS. 9 and 10 has a plurality of parallel lease members (a plurality of parallel lease rods 18*a*–18*g*) longitudinally extending alongside of the warper drum A. The basic structure and operation of the sample warpers W are well known as by the above-mentioned Japanese publications, so their detailed description is omitted here.

Japanese Patent No. 2854789 discloses a sample warper capable of winding a yarn orderly in successive turns independently of a number of turns so as to make a long sample or a small lot of product, namely, flexible manufacturing. The basic structure and operation of this sample warper are described in the above-mentioned Japanese publications, so their detailed description is omitted here.

When long size warping orderly in successive turns (in which the number of yarn windings increases) is conducted using the above-mentioned conventional sample warpers, a yarn 22 is wound directly on the conveyer belts 17 as shown in FIG. 11. In FIG. 11, reference numeral 16 designates a drum spoke, on which a conveyer belt 17 is movably mounted. Reference character G designates guide means for winding a yarn orderly in successive turns, and reference numeral 100 designates an attaching member for attaching the guide means G on a base end of the conveyer belt 17. Since the yarn 22 is tightened on the conveyer belts 17 with a considerable amount of tension as the yarn 22 wound on the conveyer belts 17 becomes longer, the conveyer belts 17 cannot move smoothly. These conventional sample warpers are therefore disadvantageous because they require a considerable amount of power so as to drive the conveyer belts move stably.

In addition, when warping stretch yarns orderly in successive turns using the conventional sample warpers, the tension on the conveyer belts 17 would be very large during warping the stretch yarns orderly in successive turns, so that the attaching members 100 of the guide means G need to have enough strength to withstand such large amount of tension. Thus as the demand for flexible manufacturing is presumably on the rise in future, the above-described conventional sample warpers would be unable to use in the absence of some considerable reconstructions.

SUMMARY OF THE INVENTION

With the foregoing problems in view, it is an object of the present invention to provide a sample warper capable of winding a yarn with an effectively reduction of possible increase of the tension of yarns, which would unavoidably occur during conventional warping process, particularly orderly warping process in successive warp turns. Another object of the present invention is to provide a method of winding a yarn using the above-mentioned sample warper.

According to a first aspect of the present invention, there is provided a sample warper which comprises: a warper drum; a plurality of parallel conveyer belts mounted on a circumferential surface of the warper drum so as to extend in parallel to the axis of the warper drum and movable concurrently and longitudinally at a predetermined rate; at least one yarn introduction means rotatably mounted on a side surface of the warper drum for winding at least one yarn on the plural conveyer belts concurrently; a plurality of parallel lease rods longitudinally extending alongside of the warper drum for leasing the yarn; a creel supporting a plurality of bobbins from which yarns are paid out; and a plurality of short feed belts mounted on the circumferential surface of the warper drum at its end adjacent to the yarn introduction means so as to be movable in parallel to the plural conveyer belts, each of the short feed belts having an upper surface which is disposed radially outwardly of an imaginary cylindrical surface enclosing upper surfaces of the plural conveyer belts with respect to the axis of the warper drum; the yarn introduction means being operable to wind the yarns on the short feed belts so that the yarns are transferred from the short feed belts onto the plural conveyer belts for warping thereon.

As a preferred feature, the upper surfaces of the short feed belts extend radially outwardly of the imaginary cylindrical surface enclosing upper surfaces of the plural conveyer belts with respect to the axis of the warper drum. With this preferred feature, it is possible to reduce the whole tension of the yarns by transferring the yarns from the short feed belts onto the conveyer belts during the warping, thereby also reducing the tension (load) on the conveyer belts.

As another preferred feature, the short feed belts have flat surfaces, on which the yarns are to be wound, slanting down to their ends in a warping direction. The short feed belts are movable in synchronism with the movement of the conveyer belts in the same direction as that of the conveyer belts so that the yarns can be transferred onto the conveyer belts without disturbing the arrangement of turns of the yarns on the short feed belts.

As still another preferred feature, the short feed belts are also movable vertically so that the tension of the yarns can be adjustably reduced while transferring the yarns from the short feed belts onto the conveyer belts by varying the vertical positions of the short feed belts in accordance with the kind of yarns or characteristics of yarns.

As a further preferred feature, the sample warper of the present invention also has a plurality of guide means mounted on base ends of the short feed belts adjacent to the yarn introduction means for guiding the yarns from the yarn introduction means onto the short feed belts. This guide means includes a pivot disposed at the base end of the short feed belt, a guide member having a base end rotatably mounted on the pivot and a tip end normally biased so as to slant downwardly, a guide roller rotatably mounted on the tip end of the guide member, and a pair of parallel guide plates standing upright at both ends of the pivot, at least one of the two guide plates having such a shape as to guide the yarn.

As an additional preferred feature, a guide roller mounted on the tip end of the guide member is normally biased rotatably with respect to the pivot so as to slant downwardly toward the short feed belt. With this preferred feature, it is possible to slide the yarn received from the yarn introduction means down the slanting surface of the guide member, thereby leading the yarn onto the short feed belt for warping thereon. Further, because at least one of the two guide plates has such a shape as to guide the yarn, it is possible to guide the yarn effectively.

According to a second aspect of the present invention, there are provided four methods for winding yarns orderly in successive warp turns using the above-described sample warper according to the first aspect of the present invention. In the first and second methods according to the present invention, there are used the above-described sample warpers of the present invention in which the guide means are slidable in parallel to the short feed belts longitudinally thereof and yarns are orderly wound by the movement of the guide means.

The first method of the present invention for winding yarns orderly in successive warp turns using the above-described sample warper with a yarn introduction means winding a yarn in which the guide means are slidable in parallel to the short feed belts longitudinally thereof, comprises the steps of: moving the guide means in a warping direction by a distance P equal to or larger than a half of the thickness of the yarn for each revolution of the yarn introduction means; quickly moving the guide means back to the original start position by a distance Q which is equal to the product of the distance P and the preset number of multi-winding turns, i.e., a warping length when the number of revolutions of the yarn introduction means reaches the preset number of multi-winding turns; and moving the short feed belts and the plural conveyor belts in the warping direction by a distance R which is equal to a warping density, i.e., a warping width divided by the total number of winding turns. The above steps are repeated to completion of the total number of winding turns so that the yarns are wound orderly on the conveyor belts and the short feed belts.

The second method of the present invention for winding yarns orderly in successive warp turns using the above-described sample warper with a plurality of yarn introduction means winding a plurality of yarns concurrently in which the guide means are slidable in parallel to the short feed belts longitudinally thereof, comprises the steps of: moving the guide means in a warping direction by a distance $P_N$ equal to or larger than a half of the thickness of a bundle of the plural yarns for each revolution of the individual yarn introduction means; quickly moving the guide means back to the original start position by a distance $Q_N$ which is equal to the product of the distance $P_N$ and the preset number of multi-winding turns, i.e., a warping length when the number of revolutions of the individual yarn introduction means reach the preset number of multi-winding turns; and moving the short feed belts and the plural conveyor belts in the warping direction by a distance $R_N$ which is equal to the product of a distance R, which is a warping density, i.e., a warping width divided by the total number of winding turns, and the number of yarns N to be concurrently warped. The above steps are repeated to completion of the total number of winding turns so that the yarns are wound orderly on the conveyor belts and the short feed belts.

In the third and fourth methods according to the present invention, there are used the above-described sample warpers of the present invention in which the guide means are fixedly attached to the short feed belts and yarns are orderly wound by the movement of the short feed belts and the conveyor belts.

The third method of the present invention for winding yarns orderly in successive warp turns using the above-described sample warper with a yarn introduction means winding a yarn in which the guide means all fixedly attached to the short feed belts, comprises the steps of: moving the plural short feed belts and the plural conveyor belts toward the guide means in a direction opposite to a warping direction by a distance P equal to or larger than a half of the thickness of the yarn for each revolution of the yarn introduction means; and quickly moving the short feed belts and the plural conveyor belts in the warping direction by a distance T which is the sum of a distance Q which is equal to the product of the distance P and the preset number of multi-winding turns, i.e., a warping length and the distance R which is equal to a warping density, i.e., a warping width divided by the total number of winding turns when the number of revolutions of the yarn introduction means reaches the preset number of multi-winding turns. The above steps are repeated to completion of the total number of winding turns so that the yarns are wound orderly on the conveyor belts and the short feed belts.

The fourth method of the present invention for winding yarns orderly in successive warp turns using the above-described sample warper with a plurality of yarn introduction means winding a plurality of yarns concurrently in which the guide means are fixedly attached to the short feed belts, comprises the steps of: moving the short feed belt and the plural conveyor belts toward the guide means in a direction opposite to a warping direction by a distance $P_N$ equal to or larger than a half of the thickness of a bundle of the plural yarns for each revolution of the individual yarn introduction means; and quickly moving the short feed belt and the plural conveyor belts in the warping direction by a distance $T_N$ which is the sum of a distance $Q_N$ which is equal to the product of the distance $P_N$ and the preset number of multi-winding turns, i.e., a warping length and a distance $R_N$ which is the product of a distance R which is a warping density, i.e., a warping width divided by the total number of winding turns, and the number of yarns to be concurrently warped N, when the number of revolutions of the individual yarn introduction means reach the preset number of the multi-winding turns. The above steps are repeated to completion of the total number of winding turns so that the yarns are wound orderly on the conveyor belts and the short feed belts.

DESCRIPTION OF THE PREFERRED EMBODIMENTS

Preferred embodiments of the present invention will now be described with reference to the accompanying drawings. The present invention should by no means be limited to the illustrated embodiments, and various changes and modifications may be made in the present invention without departing from the technical concept of the present invention.

Figure 1:
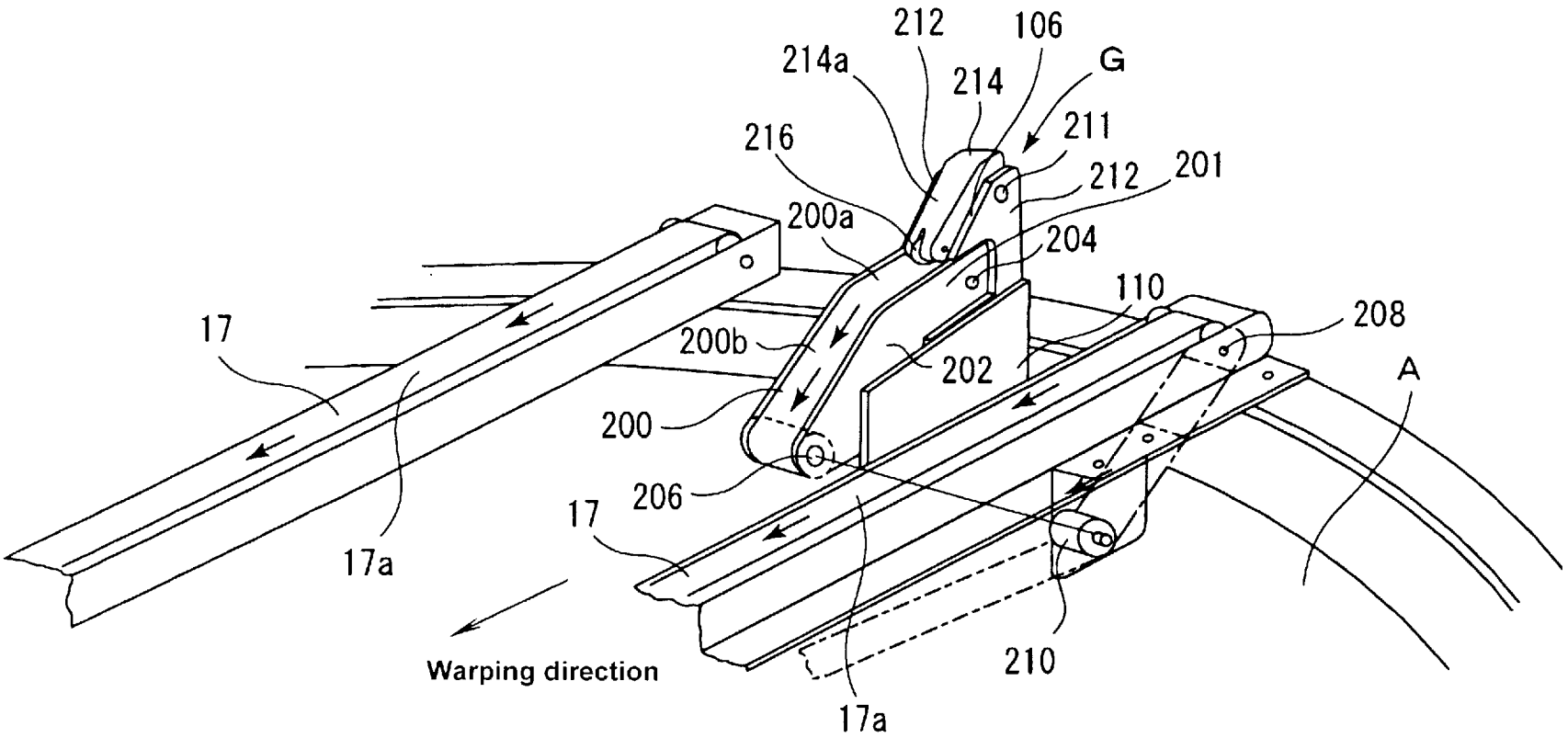
FIG. 1 is a fragmentary perspective view of a principal portion of a sample warper according to the present invention.

As shown in FIG. 1, a sample warper according to a first generic feature of the present invention a plurality of short feed belts 200 are mounted on the upper circumferential surface of a warper drum A at one base end adjacent to a yarn introduction means 6 (FIG. 4) centrally between a plurality of parallel conveyer belts 17.

Figure 4:
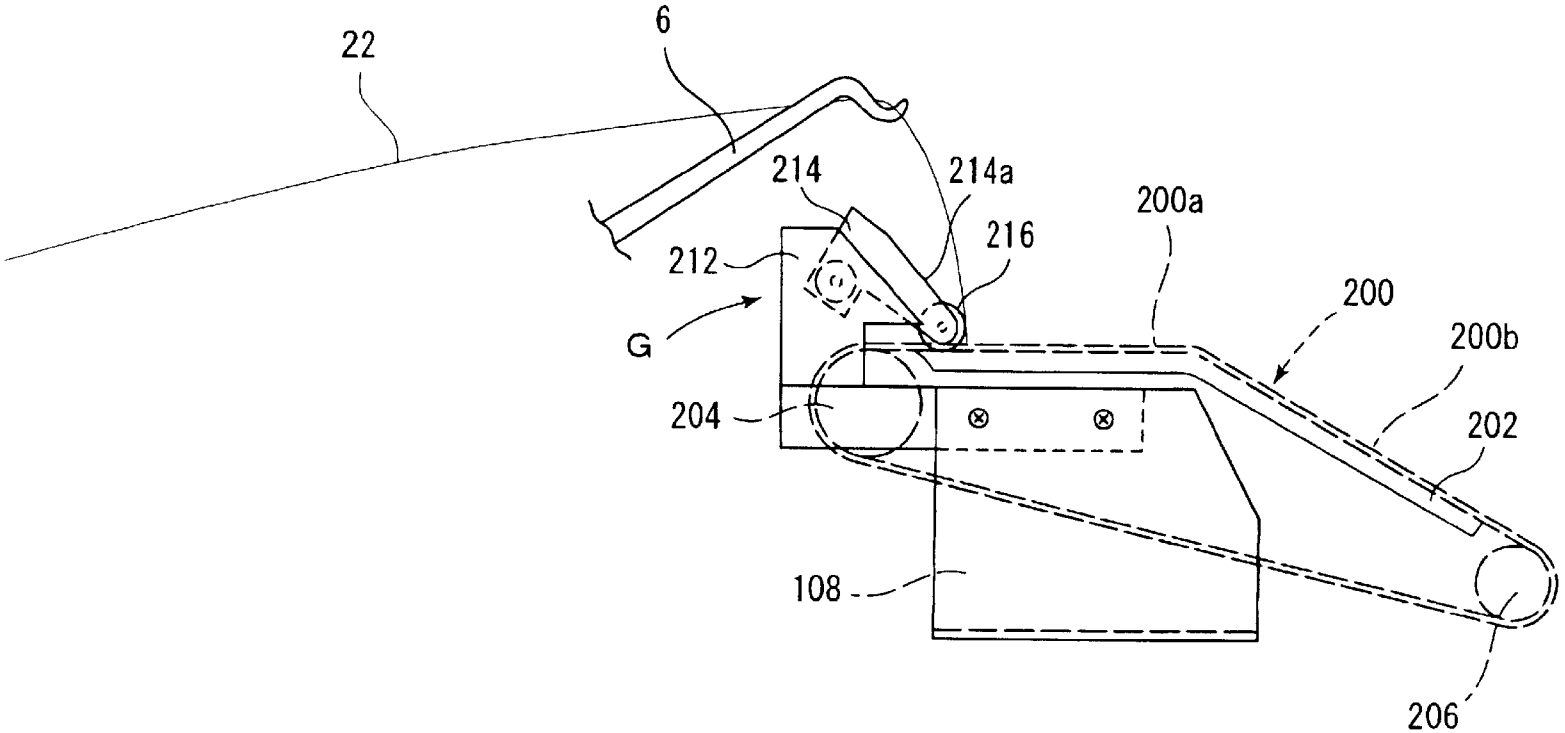
FIG. 4 is a fragmentary side view illustrating the way how to guide a yarn in the guide means.

A driving pulley 206 and a guiding pulley 204 are rotatably supported on a support frame 201 attached to the base end of the warper drum A, which is adjacent to a yarn introduction means 6 (FIG. 4). The short feed belt 200 is wound on these two pulleys 204, 206 so as to be movable thereround. A guide plate 202 of the support frame 201 is positioned in such a manner that an upper surface 200*b* of the short feed belt 200 is disposed radially outwardly of an imaginary cylindrical surface enclosing the upper surfaces of the conveyer belts 17 with respect to the axis of the warper drum A and that the upper surface 200*b* of the short feed belt 200 slants down in a warping direction.

The conveyer belts 17 is driven in response to the rotation of a driving pulley 210, which is driven by a non-illustrated AC servo-motor, to move round a guiding pulley 208. The driving pulley 206 of the short feed belt 200 is operatively connected with the driving pulley 210 of at least one of the conveyer belts 17 by a universal joint, a contractible driving shaft or the like so that the conveyer belts 17 are driven in synchronism with the short feed belt 200 by the non-illustrated AC servo-motor. Preferably, each of the conveyer belts 17 and the short feed belt 200 is a single-faced cogged belt having a flat surface, on which a yarn is to be wound, and a cogged surface engaged with a respective one of the driving pulleys 206, 210, which have the same number of cogs. It is also usable to provide separate driving motors which drive each of the conveyer belts 17 and the short feed belt 200 independently.

Figure 3:
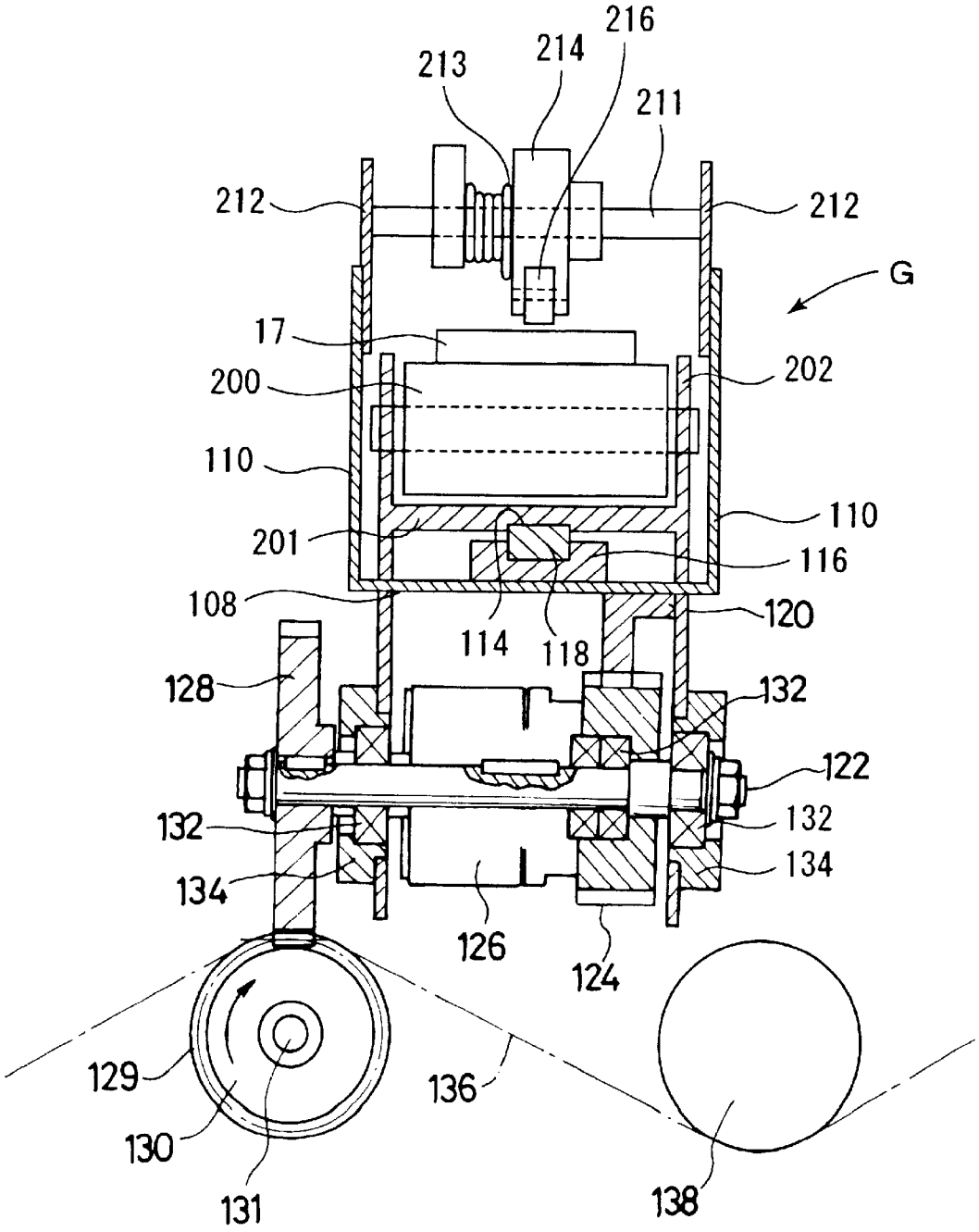
FIG. 3 is a cross-sectional view of the operation portion of the guide means.
Figure 6:
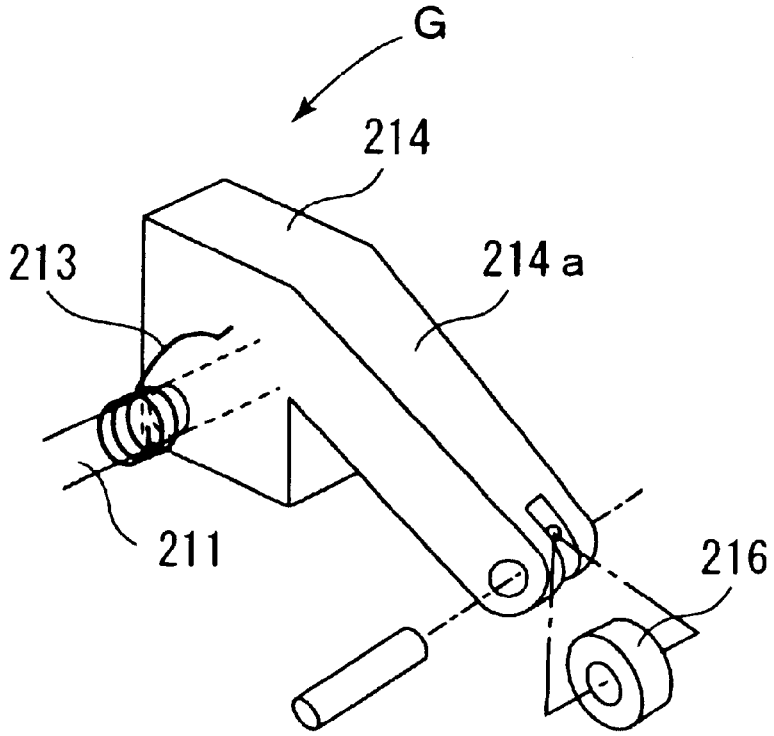
FIG. 6 is a perspective view of a guide roll and a guide member.

As shown in FIG. 4, the sample warper is further equipped with guide means G, mounted on a base end of short feed belt 200 adjacent to the yarn introduction means 6, for guiding a yarn 22 from the yarn introduction means 6. As shown in FIG. 3, the guide means G includes a pair of parallel guide plates 212, 212 standing upright and confronting each other, a pivot 211 interconnecting the guide plates 212, 212, a guide member 214, which has a base end pivotally mounted on the pivot 211 and a tip end normally biased by a spring 213 in such a manner that a yarn-slidable upper surface 214*a* of the guide member 214 slants to the tip end downwardly toward the short feed belt 200, and a guide roller 216 rotatably mounted on the tip end of the guide member 214 (FIG. 6).

Figure 5:
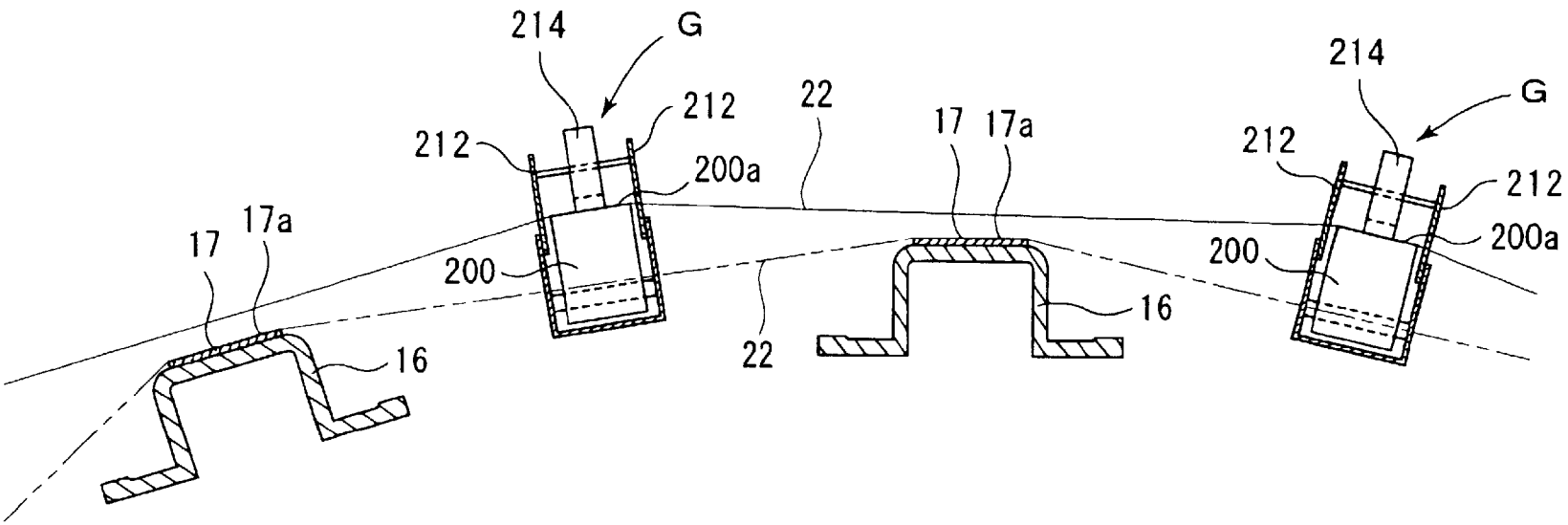
FIG. 5 is a fragmentary cross-sectional view illustrating the manner in which a yarn is wound on a short feed belt by the guide means.

The yarn 22 (or yarns) from the yarn introduction means 6 (or a plurality of yarn introduction means 6*a*–6*h*) slides down on the yarn-slidable surface 214*a* of the guide roller 216 and is thereby brought onto an upper surface 200*a* of the short feed belt 200. Thus the yarn 22 is firstly wound on the upper surface 200*a* of the base end of the short feed belt 200 without touching the upper surfaces 17*a* of the conveyer belts 17, as indicated by a solid line in FIG. 5. The yarn 22 is then transferred onto the slanting surface 200*b* downwardly toward the tip end of the short feed belt 200 in response to the movement of the short feed belt 200 being synchronized with that of the conveyer belts 17. When the yarn 22 reaches the same level as the upper surfaces 17*a* of the conveyer belts 17, the yarn 22 is delivered from the short feed belt 200 to the conveyer belts 17 and is thereby wound on the upper surfaces 17*a* of the conveyer belts 17, as indicated by a dash-and-two-dot line in FIG. 5.

Although a simple combination of the guide member 214 and the guide roller 216 would suffice to function as the guide means G, it is also effective that each of the guide plates 212, 212 has a shape in conformity to the yarn-slidable surface 214*a* of the guide means G.

Figure 2:
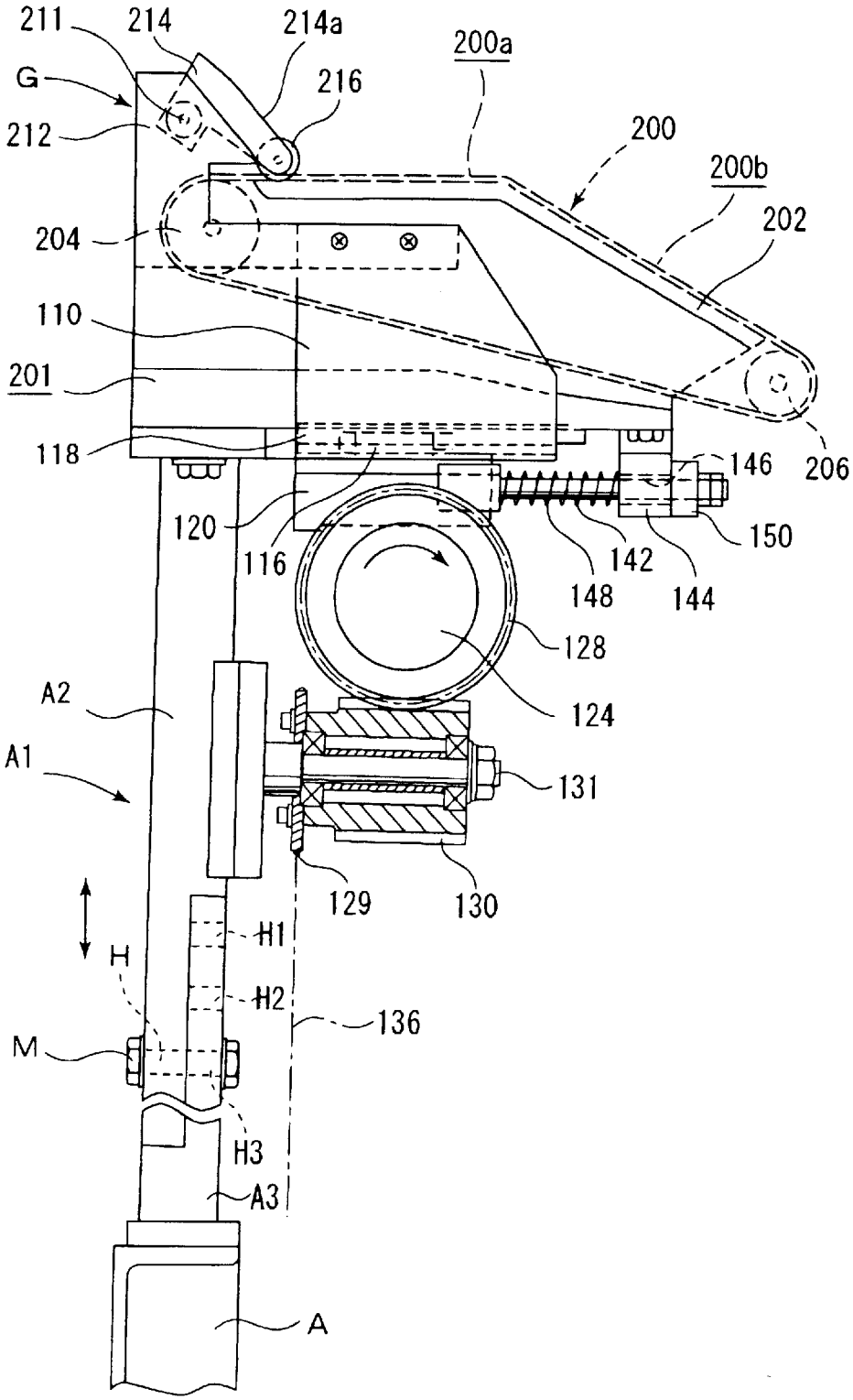
FIG. 2 is a side view with parts broken away of an operation portion of a guide means of the sample warper of FIG. 1.

As described above, simply by transferring (delivering) the yarn 22 from the short feed belt 200, which is positioned radially outwardly of the warper drum A, onto the conveyer belts 17, which are positioned radially inwardly of the warper drum A, it is possible to reduce the whole tension of the yarn 22 exerted on the warper drum A, thus facilitating the movement of the conveyer belts 17. The support frame 201 for the short feed belt 200 is attached to a support post A1 of the warper drum A as shown in FIG. 2. The support post A1 of the warper drum A is divided into upper and lower portions, and the upper post portion A2 is connected to the lower post portion A3 so as to be vertically slidable with respect to the lower post portion A3. The upper post portion A2 and the lower post portion A3 of the support A1 respectively have a hole H and a plurality of holes H1–H3 so that the upper post portion A2 can be fixed at a desired vertical position simply by fitting a bolt M through both of the hole H of the upper post portion A2 and a desired one hole H1–H3 of the lower post portion A3.

A second generic feature of the present invention is a method of winding a yarn 22 orderly in successive turns on the short feed belt 200. According to first and second methods of the present invention, a yarn is wound orderly in successive warp turns by sliding the guide means G in parallel to the short feed belt 200. The guide means G is mounted on the short feed belt 200 at its base end adjacent to the yarn introduction means so as to be slidable in parallel to the short feed belt 200 longitudinally thereof. As described above in connection with FIG. 3, the guide means G is rotatable about the pivot 211 interconnecting the confronting guide plates 212, 212, and is normally biased by the spring 213 so as to slant downwardly toward the short feed belt 200. Further, the guide means G includes the guide member 214, which has the upper surface (the yarn-slidable surface 214*a*) slanting downwardly to the tip end of the guide member 214, and the guide roller 216 rotatably mounted on the tip end of the guide member 214 (as shown in FIG. 6).

As shown in FIG. 3, the two parallel guide plates 212, 212 are respectively attached to a pair of parallel side members 110, 110 of a folder plate 108, which has a channel-like cross-sectional shape and is attached to a slide unit 116. The slide unit 116 has a guide groove 114 slidable on a slide rail 118 so that the guide means G can slide.

The folder plate 108 has a rack gear 120 mounted on a lower surface of a base part of the folder plate 108 and engageable with a clutch gear 124 of a clutch shaft 122. The clutch gear 124 is engaged and disengaged with the clutch shaft 122 (the clutch gear 124) in response to ON-OFF states of a electromagnetic clutch 126. The clutch shaft 122 has a worm wheel 128, which is attached to one end of the clutch shaft 122 and engaged with a worm 130. The worm 130 has a sprocket wheel 129 which rotates around a worm pin 131. The sprocket wheel 129 is operatively connected to the non-illustrated AC servo-motor. In FIG. 3, reference numeral 132 designates a bearing; 134, a bearing case; 136, a sprocket chain; and 138, an idle wheel.

Further, as shown in FIG. 2, an end of the rack gear 120 is attached to one end of a connection pin 142, the other end of the connection pin 142 being inserted through a hole 146 in a metal member 144 attached to the support frame 201 so that the connection pin 142 is horizontally slidable. A spring 148 is mounted round the connection pin 142 between the rack gear 120 and the metal member 144 so as to normally bias the rack gear 120 opposite to the direction of moving of the rack gear 120 in response to the rotation of the clutch gear 124. Reference numeral 150 designates a stopper for defining a position of the rack gear 120 when the electromagnetic clutch 126 assumes an OFF state.

Figure 7:
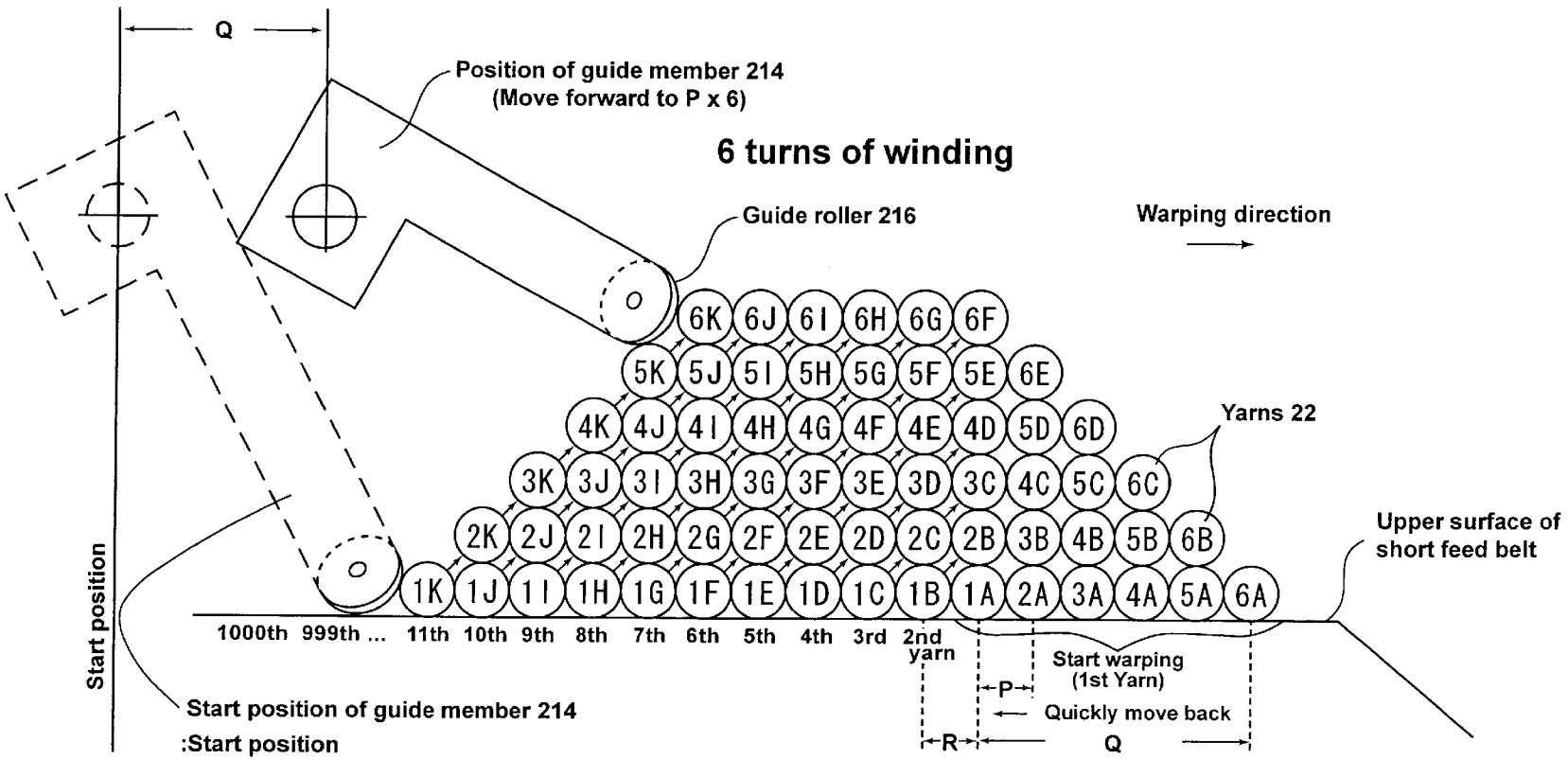
FIG. 7 is an explanatory view of a wound state according to an embodiment of a first method of the present invention.
Figure 9:
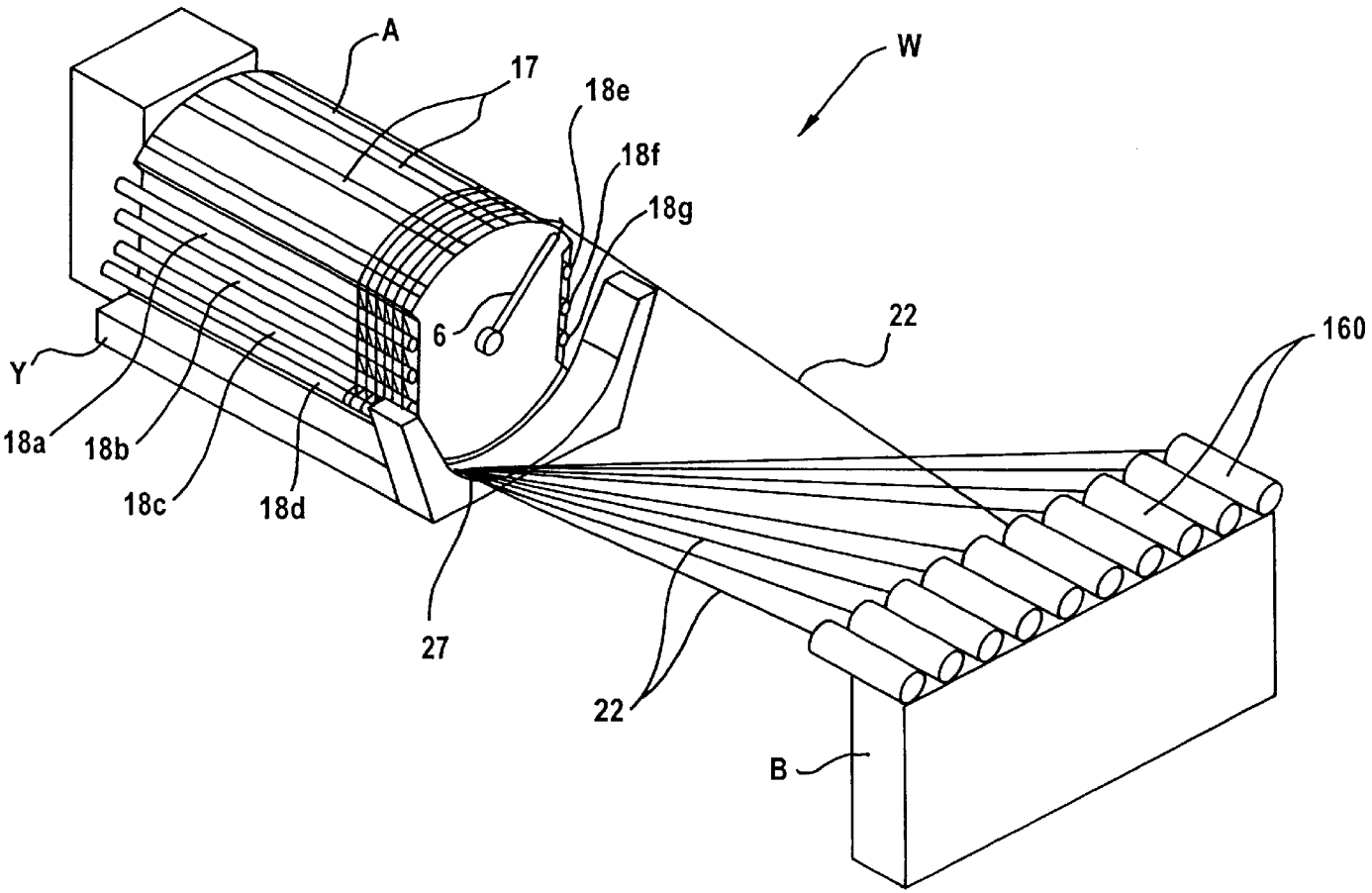
FIG.9 PRIOR ART
FIG. 9 is a perspective view of one exemplary conventional sample warper.

In an embodiment of the first method of the present invention in which, with the above-described guide means G, a yarn 22 is wound orderly in successive warp turns by a yarn introduction means 6 as shown in FIG. 9, a moving pitch or distance P of the guide means G is set in a controller (FIG. 7). The moving pitch P is equal to or larger than a half of the thickness of the warp yarn, preferably equal to or larger than the thickness of the warp yarn. Although there is no specific limitation on the upper limit of the pitch or distance P, it is preferably equal to or smaller than five times the thickness of the yarn. It is also preferable to previously store in the controller a table defining various thicknesses (for example, counts) of yarns and corresponding pitches P so that when a thickness of a warp yarn is inputted to the controller, the corresponding pitch P is automatically set in the controller.

As the warping begins, the guide means G is driven by the non-illustrated AC servo-motor to move in a warping direction by the pitch or distance P for each revolution of the yarn introduction means 6. During that time, the electromagnetic clutch 126 is in engagement with the clutch gear 124. The guide means G guides the yarn 22 from the yarn introduction means 6 to wind the yarn 22 on the upper surface 200*a* of the short feed belt 200 while moving by the pitch or distance P for each revolution of the yarn introduction means 6 until the number of revolutions of the yarn introduction means 6 reaches the preset value (the preset number of multi-winding turns). When the number of revolutions of the yarn introduction means 6 reaches the preset number of multi-winding turns, i.e., a warping length, the electromagnetic clutch 126 is de-energized to assume an OFF state and the clutch gear 124 disengages with the clutch shaft 122, so that the guide means G is quickly moved back to the original start position under the biasing force of the spring 148. A distance Q by which the guide means G moves back is equal to the distance P×the preset number of multi-winding turns (FIG. 7).

At that time, the short feed belt 200 and the conveyer belts 17 are driven by the non-illustrated AC servo-motor to move in the warping direction by a warping density, namely, by a distance R=a warping width÷the total number of winding turns. It is also preferable to divide the distance R so that the short feed belt 200 and the conveyer belts 17 move by a divided distance for each revolution of the yarn introduction means 6.

The operation of the guide means G and the short feed belt 200 will now be described with reference to FIG. 7, in which both of the moving pitch P and the distance R, which is a warping density=a warping width÷the total number of winding turns, are equal to the thickness of the warp yarn 22. In FIG. 7, the guide means G first moves from its start position (leftside in FIG. 7) in the warping direction (rightwardly in FIG. 7) by the distance P for each revolution of the yarn introduction means while winding a yarn in order of 1A-2A-3A-4A-5A-6A. When turns of winding (the number of revolutions of the yarn introduction means) reaches 6, the electromagnetic clutch 126 is de-energized to assume an OFF state and the guide means G is quickly moved back to the original start position under the biasing force of the spring 148. During that time, the short feed belt 200 moves in the warping direction (rightwardly in FIG. 7) by the distance R, i.e., a warping density=a warping width÷the total number of winding turns, so that a yarn 1B is wound at the distance R from the center of the previous yarn 1A. Then the electromagnetic clutch 126 is energized to assume an ON state and the guide means G moves again by the distance P for each revolution of the yarn introduction means while guiding a yarn B to thereby wind the yarn in the order of 2B-3B-4B-5B-6B (FIG. 7). Likewise the following yarns 1C, 1D, are successively wound to complete the orderly warping process.

Figure 10:
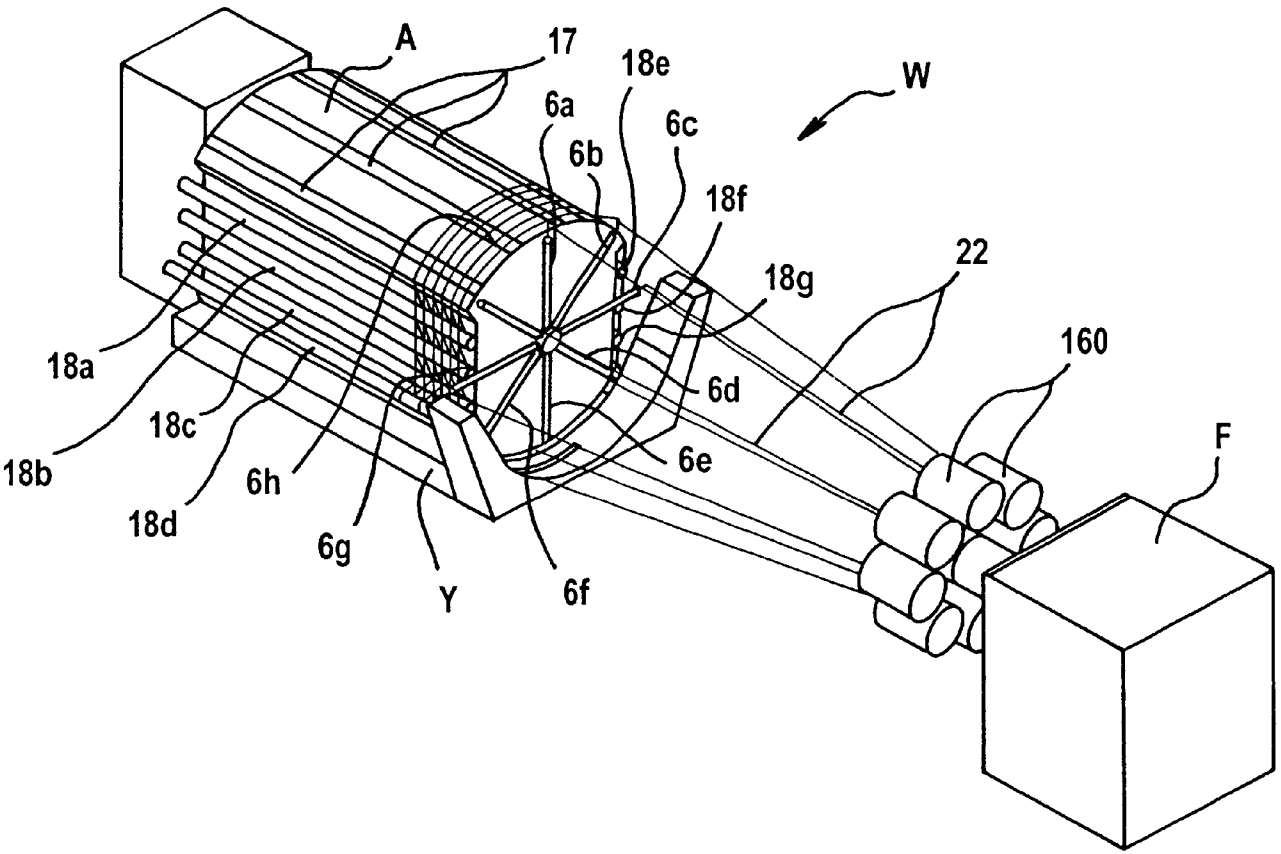
FIG.10 PRIOR ART
FIG. 10 is a perspective view of another exemplary conventional sample warper.
Figure 11:
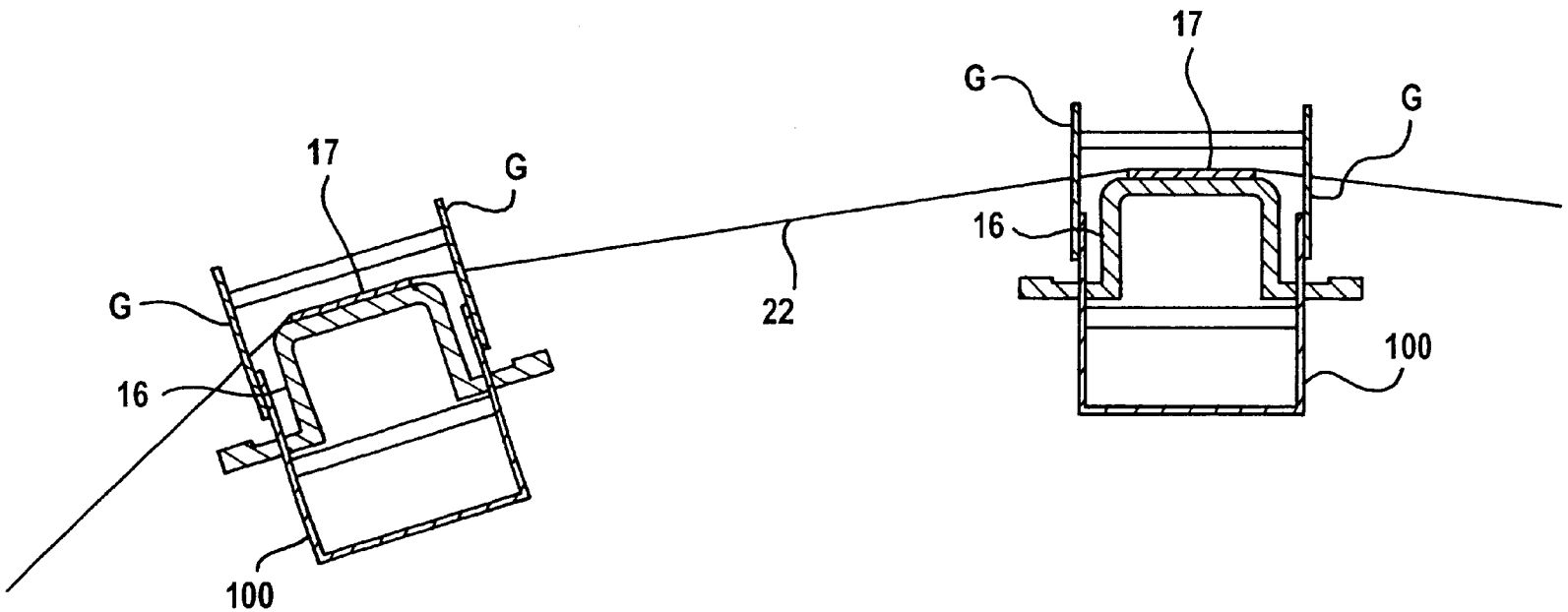
FIG.11 PRIOR ART
FIG. 11 is a cross-sectional view illustrating the manner in which a yarn is wound on conveyer belts of the conventional sample warper.

In an embodiment of the second method of the present invention in which, with the above-described guide means G, a plurality of N warp yarns 22 (for example, 8 yarns as shown in FIG. 10) are concurrently wound orderly in successive warp turns using a plurality of yarn introduction means 6*a*–6*h* shown in FIG. 10, a moving pitch or distance $P_N$ of the guide means G is set in the controller. The moving pitch $P_N$ is equal to or larger than a half of the thickness D of a bundle of the plural warp yarns, preferably equal to or larger than the thickness D of a bundle of the plural warp yarns. It is also preferable to previously store in the controller a table defining various thicknesses (for example, counts) of yarns, preset numbers of multi-winding turns and corresponding pitches $P_N$ so that when the thicknesses (for example, counts) of the warp yarns and the preset number of multi-winding turns are inputted to the controller, the corresponding pitch $P_N$ is automatically set in the controller. Although there is no specific limitation on the upper limit of the pitch or distance $P_N$, it is preferably equal to or smaller than five times the thickness of the bundle of the plural yarns.

The above-mentioned thickness D of the bundle of the plural warp yarns is defined as shown in FIG. (b) to (p); that is, the plural warp yarns to be warped concurrently are imagined as states of bundles thereof and as the thickness of each bundle of various plural warp yarns to be warped concurrently, the following hypothetical value may be used; in case of 2 and 3 warp yarns, the thickness D of the bundle thereof is D=2d (d: the thickness of a warp yarn); 4 yarns, D=2.6d; 5 to 7 yarns, D=3d; 8 yarns, D=3.5d; 9 to 12 yarns, D=4d, 13 and 14 yarns, D=4.4d, 15 and 16 yarns, D=5d.

As the warping begins, the guide means G is driven by the non-illustrated AC servo-motor to move by the distance $P_N$ in the warping direction for each revolution of the individual yarn introduction means 6*a*–6*h*, the electromagnetic clutch 126 being engaged with the clutch gear 124. The guide means G guides the yarns 22 from the yarn introduction means 6*a*–6*h* to wind the yarns on the upper surface 200*a* of the short feed belt 200 while moving by the pitch or distance $P_N$ for each revolution of the individual yarn introduction means 6*a*–6*h* until the number of revolutions of the individual yarn introduction means 6*a*–6*h* reaches the preset number of multi-winding turns. When the number of revolutions of the individual yarn introduction means 6*a*–6*h* reaches the preset number of multi-winding turns, the electromagnetic clutch 126 is de-energized to assume an OFF state and the clutch gear 124 disengages from the clutch shaft 122 so that the guide means G is quickly moved back to the original start position under the biasing force of the spring 148. A distance $Q_N$ by which the guide means G moves back is equal to the distance $P_N$×the preset number of multi-winding turns.

At that time, the short feed belt 200 and the conveyer belts 17 are driven by the non-illustrated AC servo-motor to move in the warping direction by a distance $R_N$ which is the product of a distance R, which is a warping density=a warping width÷the total number of winding turns, and N yarns to be concurrently warped. It is also preferable to divide the distance $R_N$ so that the short feed belt 200 and the conveyer belts 17 move by a divided distance for each revolution of the individual yarn introduction means 6*a*–6*h*.

In the above-described warping process, the distance R or the distance $R_N$ is automatically calculated in the controller using input warping data including the warping width, the total number of winding turns and the number of yarns N to be concurrently warped, so that the short feed belt 200 and the conveyer belts 17 are automatically driven to move in accordance with the distance R or the distance $R_N$.

According to third and fourth methods of the present invention, a yarn is wound orderly in successive warp turns by moving the short feed belt 200 and the conveyer belts 17, without sliding the guide means G in parallel to the short feed belt 200. As described above in connection with FIG. 3, the guide means G is rotatable about the pivot 211 interconnecting the confronting guide plates 212, 212 and is normally biased by the spring 213 to slant downwardly toward the short feed belt 200. Further, the guide means G includes the guide member 214, which has an upper surface 214*a* (on which a yarn is slidable) slanting to the tip end of the guide member 214 downwardly, and the guide roller 216 rotatably mounted on the tip end of the guide member 214. And the guide plates 212, 212 are fixed directly to the support frame 201 of the short feed belt 200.

In an embodiment of the third method of the present invention in which a warp yarn 22 is wound orderly in successive warp turns using a sample warper including a yarn introduction means 6 shown in FIG. 9, a moving pitch or distance P of the short feed belt 200 and the conveyer belts 17 are set in a controller. The moving pitch or distance P is equal to or larger than a half of the thickness of the warp yarn, preferably equal to or larger than the thickness of the warp yarn. Although there is no specific limitation on the upper limit of the pitch or distance P, it is preferably equal to or smaller than five times the thickness of the yarns. It is also preferable to previously store in the controller a table defining various thicknesses (for example, counts) of yarns and corresponding pitches P so that when a thickness of the warp yarn is inputted to the controller, the corresponding pitch P is automatically set in the controller.

As the warping begins, the short feed belt 200 and the conveyer belts 17 move by a distance P toward the guide means G in the direction opposite to the warping direction for each revolution of the yarn introduction means 6 while guiding the yarn 22 from the guide means G to wind the yarn 22 on the upper surface 200*a* of the short feed belt 200 until the number of revolutions of the yarn introduction means 6 reaches the preset number of multi-winding turns. When the number of revolutions of the yarn introduction means 6 reaches the preset value (the preset number of multi-winding turns), the short feed belt 200 and the conveyer belts 17 quickly moves in the warping direction by a distance T, which is the sum of a distance Q=the distance P×the preset number of multi-winding turns and a distance R, i.e., a warping density=a warping width÷the total number of winding turns.

Figure 8:
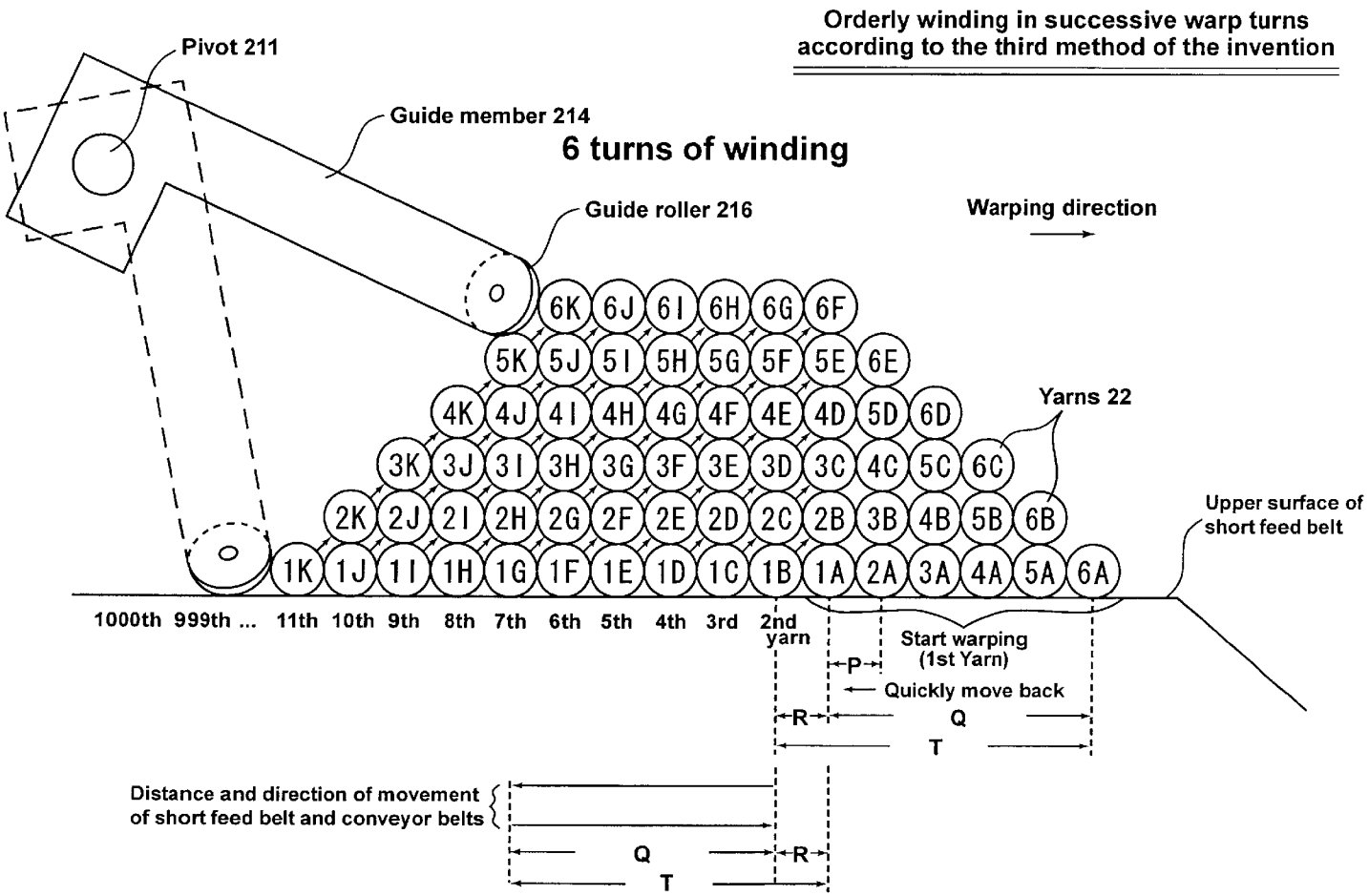
FIG. 8 is an explanatory view of a wound state according to an embodiment of a second method of the present invention.

The operation of the short feed belt 200 and the conveyer belts 17 will now be described with reference to FIG. 8, in which both of the moving pitch or distance P and the distance R, which is a warping density=a warping width÷the total number of winding turns, are equal to the thickness of the warp yarn 22. In FIG. 8, the guide means G is located at such a leftside position (leftside in FIG. 8) as not to slide longitudinally of the short feed belt 200, and is normally biased by the spring 213 to angularly move toward the short feed belt 200 about the pivot 211. First of all, the short feed belt 200 and the conveyer belts 17 move toward the guide means G in the direction opposite to the warping direction by a distance P equal to or larger than a half of the thickness of the yarn for each revolution of the yarn introduction means while a yarn is wound by the guide member 214 and the guide roller 216 of the guide means G on the upper surface 200*a* of the short feed belt 200 in order of 1A-2A-3A-4A-5A-6A. When the number of multi-winding turns reaches 6, the short feed belt 200 and the conveyer belts 17 quickly move in the warping direction by a distance T, which is the sum of a distance Q=the distance P×6 (the preset number of multi-winding turns) and a distance R, i.e., a warping density=a warping width÷the total number of winding turns, so that a yarn 1B is wound at the distance R from the center of the previous yarn 1A. Then the short feed belt 200 and the conveyer belts 17 move again by the distance P for each revolution of the yarn introduction means to wind a yarn B in order of 2B-3B-4B-5B-6B as shown in FIG. 8. Likewise the following yarns 1C, 1D, . . . , 1K are wound to complete the orderly winding in successive warp turns.

Figure 12:
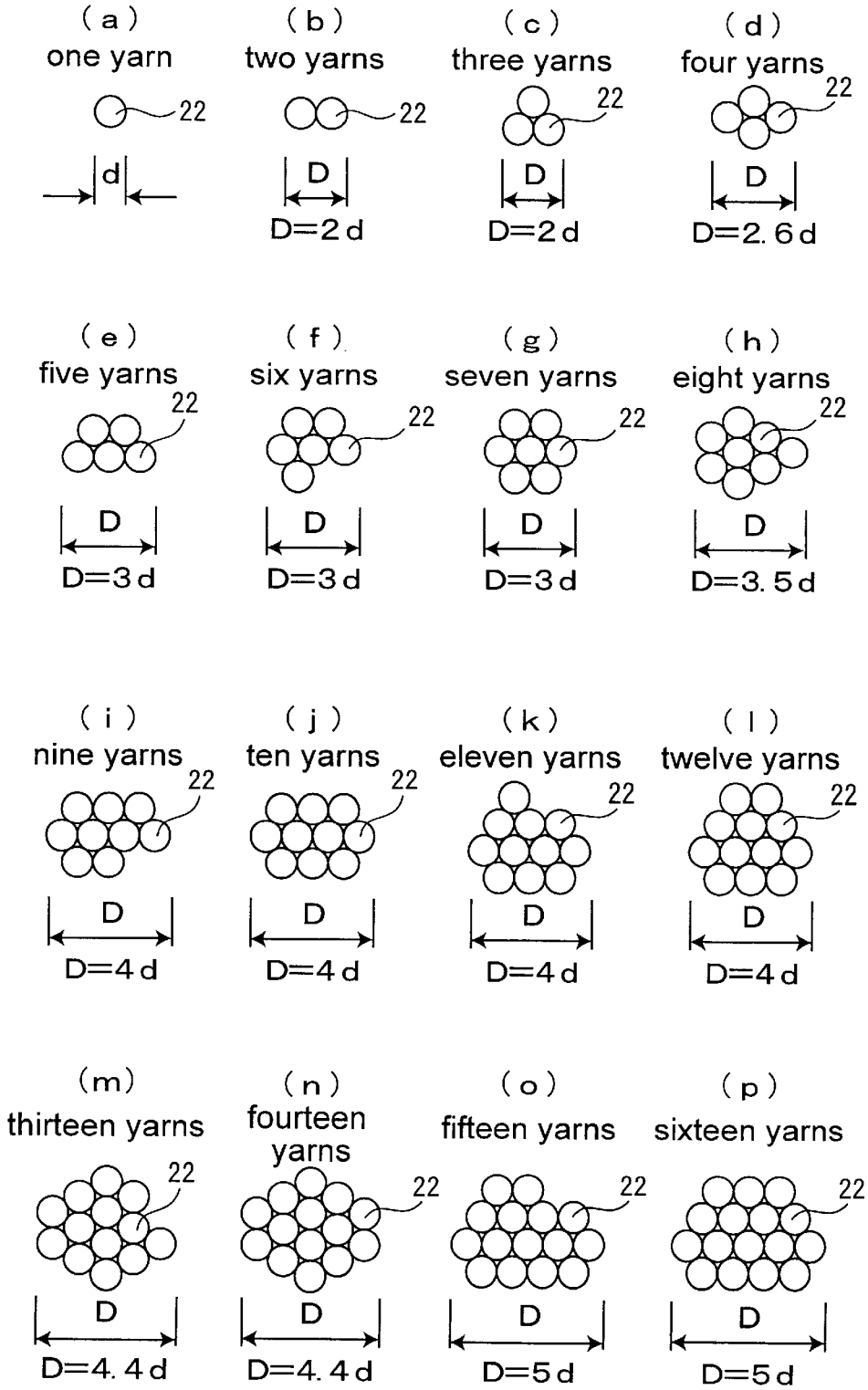
FIG. 12 is an explanatory view showing how to set the thickness (d) of a yarn (a) and the thicknesses (D) of bundles of a plurality of yarns (b) to (p).

In an embodiment of the fourth method of the present invention in which a plurality of warp yarns 22 are concurrently wound orderly in successive warp turns using a plurality of yarn introduction means 6*a*–6*h*, a moving pitch or distance $P_N$ of the short feed belt 200 and the conveyer belts 17 is set in the controller. The moving pitch or distance P is equal to or larger than a half of the thickness of a bundle of the plural warp yarns, preferably equal to or larger than the total size of the plural warp yarns. Although there is no specific limitation on the upper limit of the pitch or distance $P_N$, it is preferably equal to or smaller than five times the thickness of bundle of the plural yarns. As the thickness of the bundle of the plural yarns, the hypothetical values shown in FIG. 12 may be used also in this method. It is also preferable to previously store in the controller a table defining various thicknesses (for example, counts) of yarns, preset numbers of multi-winding turns and corresponding pitches $P_N$ so that when the thickness (for example, count) of the warp yarns and the preset number of multi-winding turns are inputted to the controller, the corresponding pitch $P_N$ is automatically set in the controller.

As the warping begins, the short feed belt 200 and the conveyer belts 17 move by a distance $P_N$ toward the guide means G in the direction opposite to the warping direction for each revolution of the individual yarn introduction means 6*a*–6*h* while guiding the yarns 22 from the guide means G to wind the yarns 22 on the upper surface 200*a* of the short feed belt 200 until the number of revolutions of the yarn introduction means 6*a*–6*h* reaches the preset number of multi-winding turns. When the number of revolutions of the individual yarn introduction means 6*a*–6*h* reaches the preset value (the preset number of multi-winding turns), the short feed belt 200 and the conveyer belts 17 quickly moves in the warping direction by a distance $T_N$, which is the sum of a distance $Q_N$=distance $P_N$×the preset number of multi-winding turns and a distance $R_N$ which is the product of a distance R, which is a warping density=a warping width÷the total number of winding turns, and the number of yarns to be concurrently warped N.

In the above-described methods of the present invention for winding yarns in successive warp turns, when a first series of yarns has been wound on the warper drum, the leading yarn of the following series of yarns begins to be wound at a position ahead of the yarns of the first series.

According to the present invention, it is possible to effectively reduce the increase of tension of yarn, which would unavoidably occur during the conventional warping process, specifically during the conventional orderly warping process in successive warp turns.

Obviously, various minor changes and modifications of the present invention are possible in the light of the above teaching. It is therefore to be understood that within the scope of the appended claims the present invention may be practiced otherwise than as specifically described.

What is claimed is:

1. A sample warper comprising:

a warper drum;

a plurality of parallel conveyer belts mounted on a circumferential surface of said warper drum so as to extend in parallel to the axis of said warper drum and movable concurrently and longitudinally at a predetermined rate;

at least one yarn introduction means, rotatably mounted on a side surface of said warper drum for winding at least one yarn on said plural conveyer belts concurrently;

a plurality of parallel lease rods longitudinally extending alongside of said warper drum for leasing the yarn;

a creel supporting a plurality of bobbins from which yarns are paid out; and a plurality of short feed belts mounted on the circumferential surface of said warper drum at its end adjacent to said yarn introduction means so as to be movable in parallel to said plural conveyer belts, each of said short feed belts having an upper surface which is disposed radially outwardly of an imaginary cylindrical surface enclosing upper surfaces of the plural conveyer belts with respect to the axis of said warper drum;

said yarn introduction means being operable to wind the yarns on said short feed belts so that the yarns are transferred from said short feed belts onto said plural conveyer belts for warping thereon.

2. A sample warper according to claim 1, wherein the upper surfaces of said short feed belts slant down to their ends.

3. A sample warper according to claim 1 or 2, wherein said short feed belts are movable in synchronism with the movement of said plural conveyer belts in the same direction as that of said plural conveyer belts.

4. A sample warper according to claim 1 or 2, wherein said short feed belts are movable vertically.

5. A sample warper according to claim 3, wherein said short feed belts are movable vertically.

6. A sample warper according to claim 1 or 2, further comprising a plurality of guide means mounted on base ends of said short feed belts adjacent to said yarn introduction means for guiding the yarns from said yarn introduction means onto said short feed belts.

7. A sample warper according to claim 3, further comprising a plurality of guide means mounted on base ends of said short feed belts adjacent to said yarn introduction means for guiding the yarns from said yarn introduction means onto said short feed belts.

8. A sample warper according to claim 4, further comprising a plurality of guide means mounted on base ends of said short feed belts adjacent to said yarn introduction means for guiding the yarns from said yarn introduction means onto said short feed belts.

9. A sample warper according to claim 6, wherein said guide means includes a pivot disposed at the base end of said short feed belt, a guide member having a base end rotatably mounted on said pivot and a tip end normally biased so as to slant downwardly, and a guide roller rotatably mounted on the tip end of said guide member.

10. A sample warper according to claim 7, wherein said guide means includes a pivot disposed at the base end of said short feed belt, a guide member having a base end rotatably mounted on said pivot and a tip end normally biased so as to slant downwardly, and a guide roller rotatably mounted on the tip end of said guide member.

11. A sample warper according to claim 8, wherein said guide means includes a pivot disposed at the base end of said short feed belt, a guide member having a base end rotatably mounted on said pivot and a tip end normally biased so as to slant downwardly, and a guide roller rotatably mounted on the tip end of said guide member.

12. A sample warper according to claim 6, wherein said guide means further includes a pair of parallel guide plates standing upright at both ends of said pivot, at least one of the two guide plates having such a shape as to guide the yarn.

13. A sample warper according to claim 7, wherein said guide means further includes a pair of parallel guide plates standing upright at both ends of said pivot, at least one of the two guide plates having such a shape as to guide the yarn.

14. A sample warper according to claim 8, wherein said guide means further includes a pair of parallel guide plates standing upright at both ends of said pivot, at least one of the two guide plates having such a shape as to guide the yarn.

15. A sample warper according to claim 9, wherein said guide means further includes a pair of parallel guide plates standing upright at both ends of said pivot, at least one of the two guide plates having such a shape as to guide the yarn.

16. A sample warper according to claim 10, wherein said guide means further includes a pair of parallel guide plates standing upright at both ends of said pivot, at least one of the two guide plates having such a shape as to guide the yarn.

17. A sample warper according to claim 11, wherein said guide means further includes a pair of parallel guide plates standing upright at both ends of said pivot, at least one of the two guide plates having such a shape as to guide the yarn.

18. A sample warper according to claim 6, wherein said guide means is slidable in parallel to said short feed belt longitudinally thereof.

19. A sample warper according to claim 7, wherein said guide means is slidable in parallel to said short feed belt longitudinally thereof.

20. A sample warper according to claim 8, wherein said guide means is slidable in parallel to said short feed belt longitudinally thereof.

21. A sample warper according to claim 9, wherein said guide means is slidable in parallel to said short feed belt longitudinally thereof.

22. A sample warper according to claim 10, wherein said guide means is slidable in parallel to said short feed belt longitudinally thereof.

23. A sample warper according to claim 11, wherein said guide means is slidable in parallel to said short feed belt longitudinally thereof.

24. A sample warper according to claim 12, wherein said guide means is slidable in parallel to said short feed belt longitudinally thereof.

25. A sample warper according to claim 13, wherein said guide means is slidable in parallel to said short feed belt longitudinally thereof.

26. A sample warper according to claim 14, wherein said guide means is slidable in parallel to said short feed belt longitudinally thereof.

27. A sample warper according to claim 15, wherein said guide means is slidable in parallel to said short feed belt longitudinally thereof.

28. A sample warper according to claim 16, wherein said guide means is slidable in parallel to said short feed belt longitudinally thereof.

29. A sample warper according to claim 17, wherein said guide means is slidable in parallel to said short feed belt longitudinally thereof.

30. A sample warper according to claim 6, wherein said guide means is fixedly attached to said short feed belt.

31. A sample warper according to claim 7, wherein said guide means is fixedly attached to said short feed belt.

32. A sample warper according to claim 8, wherein said guide means is fixedly attached to said short feed belt.

33. A sample warper according to claim 9, wherein said guide means is fixedly attached to said short feed belt.

34. A sample warper according to claim 10, wherein said guide means is fixedly attached to said short feed belt.

35. A sample warper according to claim 11, wherein said guide means is fixedly attached to said short feed belt.

36. A sample warper according to claim 12, wherein said guide means is fixedly attached to said short feed belt.

37. A sample warper according to claim 13, wherein said guide means is fixedly attached to said short feed belt.

38. A sample warper according to claim 14, wherein said guide means is fixedly attached to said short feed belt.

39. A sample warper according to claim 15, wherein said guide means is fixedly attached to said short feed belt.

40. A sample warper according to claim 16, wherein said guide means is fixedly attached to said short feed belt.

41. A sample warper according to claim 17, wherein said guide means is fixedly attached to said short feed belt.

42. A method of winding yarns orderly in successive warp turns using a sample warper comprising:

a warper drum;

a plurality of parallel conveyer belts mounted on a circumferential surface of said warper drum so as to extend in parallel to the axis of said warper drum and movable concurrently and longitudinally moving at a predetermined rate;

a yarn introduction means rotatably mounted on a side surface of said warper drum for winding a yarn on said plural conveyer belts;

a plurality of parallel lease rods longitudinally extending alongside of said warper drum for leasing yarns;

a creel supporting a plurality of bobbins from which yarns are paid out;

a plurality of short feed belts mounted on the circumferential surface of said warper drum at its end adjacent to said yarn introduction means so as to be movable in parallel to said plural conveyer belts, each of said short feed belts having an upper surface which is disposed radially outwardly of an imaginary cylindrical surface enclosing upper surfaces of the plural conveyer belts with respect to the axis of said warper drum; and guide means mounted on base ends of said short feed belts adjacent to said yarn introduction means for guiding the yarns from said yarn introduction means onto said short feed belts, said guide means being slidable in parallel to said short feed belt longitudinally thereof;

said yarn introduction means being operable to wind the yarns on said short feed belts so that the yarns are transferred from said short feed belt onto said plural conveyer belts for warping thereon;

wherein said method comprises the steps of:

moving said guide means in a warping direction by a distance P equal to or larger than a half of the thickness of the yarn for each revolution of said yarn introduction means;

quickly moving said guide means back to the original start position by a distance Q which is equal to the product of the distance P and the preset number of multi-winding turns when the number of revolutions of said yarn introduction means reaches said preset number of multi-winding turns; and moving said short feed belts and said plural conveyor belts in said warping direction by a distance R which is equal to a warping density, i.e., a warping width divided by the total number of winding turns.

43. A method of winding yarns orderly in successive turns using a sample warper, comprising:

a warper drum;

a plurality of parallel conveyer belts mounted on a circumferential surface of said warper drum so as to extend in parallel to the axis of said warper drum and movable concurrently and longitudinally at a predetermined rate;

a plurality of yarn introduction means rotatably mounted on a side surface of said warper drum for winding a plurality of yarns concurrently on said plural conveyer belts;

a plurality of parallel lease rods longitudinally extending alongside of said warper drum for leasing yarns;

a creel supporting a plurality of bobbins from which yarns are paid out;

a plurality of short feed belts mounted on the circumferential surface of said warper drum at its end adjacent to said yarn introduction means so as to be movable in parallel to said plural conveyer belts, each of said short feed belts having an upper surface which is disposed radially outwardly of an imaginary cylindrical surface enclosing upper surfaces of the plural conveyer belts with respect to the axis of said warper drum; and guide means mounted on base ends of said short feed belts adjacent to said yarn introduction means for guiding the yarns from said yarn introduction means onto said short feed belts, said guide means being slidable in parallel to said short feed belt longitudinally thereof;

said yarn introduction means being operable to wind the yarns on said short feed belts so that the yarns are transferred from said short feed belt onto said plural conveyer belts for warping thereon;

wherein said method comprises the steps of:

moving said guide means in a warping direction by a distance $P_N$ equal to or larger than a half of the thickness of a bundle of the plural yarns for each revolution of the individual yarn introduction means;

quickly moving said guide means back to the original start position by a distance $Q_N$ which is equal to the product of the distance $P_N$ and the preset number of multi-winding turns when the number of revolutions of said individual yarn introduction means reaches said preset number of multi-winding turns; and moving said short feed belts and said plural conveyor belts in said warping direction by a distance $R_N$ which is equal to the product of a distance R, which is a warping density, i.e., a warping width divided by the total number of winding turns, and the number of yarns to be concurrently warped N.

44. A method of winding yarns orderly in successively warp turns using a sample warper, comprising:

a warper drum;

a plurality of parallel conveyer belts mounted on a circumferential surface of said warper drum so as to extend in parallel to the axis of said warper drum and movable concurrently and longitudinally moving at a predetermined rate;

a yarn introduction means rotatably mounted on a side surface of said warper drum for winding a yarn on said plural conveyer belts;

a plurality of parallel lease rods longitudinally extending alongside of said warper drum for leasing yarns;

a creel supporting a plurality of bobbins from which yarns are paid out;

a plurality of short feed belts mounted on the circumferential surface of said warper drum at its end adjacent to said yarn introduction means so as to be movable in parallel to said plural conveyer belts, each of said short feed belts having an upper surface which is disposed radially outwardly of an imaginary cylindrical surface enclosing upper surfaces of the plural conveyer belts with respect to the axis of said warper drum; and guide means mounted on base ends of said short feed belts adjacent to said yarn introduction means for guiding the yarns from said yarn introduction means onto said short feed belts, said guide means being fixed to said short feed belt;

said yarn introduction means being operable to wind the yarns on said short feed belts so that the yarns are transferred from said short feed belt onto said plural conveyer belts for warping thereon;

wherein said method comprises the steps of:

moving said plural short feed belts and said plural conveyor belts toward said guide means in a direction opposite to a warping direction by a distance P equal to or larger than a half of the thickness of the yarn for each revolution of said yarn introduction means; and quickly moving said short feed belt and said plural conveyor belts in said warping direction by a distance T which is the sum of a distance Q which is equal to the product of the distance P and the preset number of multi-winding turns and a distance R which is equal to a warping density, i.e., a warping width divided by the total number of winding turns when the number of revolutions of said single yarn introduction means reaches said preset number of multi-winding turns.

45. A method of winding yarns orderly in successive warp turns using a sample warper, comprising:

a warper drum;

a plurality of parallel conveyer belts mounted on a circumferential surface of said warper drum so as to extend in parallel to the axis of said warper drum and movable concurrently and longitudinally moving at a predetermined rate;

a plurality of yarn introduction means rotatably mounted on a side surface of said warper drum for winding a plurality of yarns concurrently on said plural conveyer belts;

a plurality of parallel lease rods longitudinally extending alongside of said warper drum for leasing yarns;

a creel supporting a plurality of bobbins from which yarns are paid out;

a plurality of short feed belts mounted on the circumferential surface of said warper drum at its end adjacent to said yarn introduction means so as to be movable in parallel to said plural conveyer belts, each of said short feed belts having an upper surface which is disposed radially outwardly of an imaginary cylindrical surface enclosing upper surfaces of the plural conveyer belts with respect to the axis of said warper drum; and guide means mounted on base ends of said short feed belts adjacent to said yarn introduction means for guiding the yarns from said yarn introduction means onto said short feed belts, said guide means being fixed to said short feed belt;

said yarn introduction means being operable to wind the yarn on said short feed belts so that the yarns are transferred from said short feed belt onto said plural conveyer belts for warping thereon;

wherein said method comprises the steps of:

moving said short feed belt and said plural conveyor belts toward said guide means in a direction opposite to a warping direction by a distance $P_N$ equal to or larger than a half of the total thickness of a bundle of the plural yarns for each revolution of the individual yarn introduction means; and quickly moving said short feed belt and said plural conveyor belts in said warping direction by a distance $T_N$, which is the sum of a distance $Q_N$ which is equal to the product of the distance $P_N$ and the preset number of multi-winding turns and a distance $R_N$ which is equal to the product of a distance R, which is a warping density, i.e., a warping width divided by the total number of winding turns, and the number of yarns to be concurrently warped N, when the number of revolutions of said individual yarn introduction means reaches said preset number of multi-winding turns.

* * * * *